US005180151A

United States Patent [19]

Branecky et al.

[11] Patent Number: 5,180,151

[45] Date of Patent: Jan. 19, 1993

[54] GROOVED PAPER FOLDING ROLLERS

[75] Inventors: George N. Branecky, Bethel; John F. Pezzuti, Naugatuck, both of Conn.

[73] Assignee: Pitney Bowes Inc., Stamford, Conn.

[21] Appl. No.: 814,523

[22] Filed: Dec. 30, 1991

[51] Int. Cl.[5] ..... B42C 1/00; B31F 1/00

[52] U.S. Cl. ..... 270/45; 493/420

[58] Field of Search ..... 270/32, 45, 47, 51; 493/419, 420, 421

[56] References Cited

U.S. PATENT DOCUMENTS

| | | | |
|---|---|---|---|
| 3,057,621 | 10/1962 | Klaus | 493/421 |
| 4,032,133 | 6/1977 | Steffens | 493/421 |
| 4,375,971 | 3/1983 | Moll | 493/420 |
| 4,650,454 | 3/1987 | Moll | 493/420 |
| 5,048,809 | 9/1991 | Tebbe | 270/45 |
| 5,129,876 | 7/1992 | Brabant et al. | 493/419 X |

FOREIGN PATENT DOCUMENTS

| | | | |
|---|---|---|---|
| 3440775 | 7/1985 | Fed. Rep. of Germany | 270/47 |

*Primary Examiner*—Edward K. Look
*Assistant Examiner*—John Ryznic
*Attorney, Agent, or Firm*—Charles R. Malandra, Jr.; Melvin J. Scolnick

[57] ABSTRACT

A buckle chute folder for folding one or more sheets of paper, including a buckle chute and a pair of folding rollers situated downstream of the buckle chute. Each of the folding rollers has a plurality of circumferential grooves extending perpendicular to the axis of the roller, and the grooves of one roller are offset with respect to the grooves of the other roller.

6 Claims, 3 Drawing Sheets

GROOVED PAPER FOLDING ROLLERS

BACKGROUND OF THE INVENTION

The instant invention relates to buckle chute folders for folding one or more sheets of paper, and more particularly to the folding rollers used to impart a crease to the sheets of paper.

Buckle chute paper folders employing folding rollers are well known. The sheet of paper is fed by a first pair of feed rollers up into a buckle chute, which stops the forward progress of the paper sheet and causes a buckle to be formed. The buckle is then forced to enter the nip of a pair of folding rollers (one of which may be one of the feed rollers) which impart a crease in the buckle. The folding rollers then continue to feed the folded sheet toward a pair of exit rollers or another buckle chute for forming a second fold.

Buckle chute folders are used to fold single sheets and a plurality of sheets. The folding rollers are biased toward each other, and can be adjusted to generate the optimum pressure for a given number of sheets to be folded at once. Obviously, an optimum pressure for folding a packet of ten sheets would not be an optimum pressure for folding a single sheet. Thus, when a buckle chute folder is being used to fold various numbers of sheets in succession, some of the packets will not be folded as well as some other packets depending on the adjustment of the pressure for the folding rollers.

Because the conventional folding rollers are biased toward each other with springs, there is a limit to the number of sheets which can be folded at one time, which generally is about 12 sheets.

The instant invention overcomes the foregoing problems and provides a pair of folding rollers which will fold thin collations as well as thick collations and not derogate from the quality of folding because of variations in the thickness of the packet being folded. The instant invention also increases the number of sheets which can be folded in a single packet over the number which can be folded by conventional folding rollers. Thus, the instant invention provides improved quality in buckle chute folding and increases the number of sheets which can be folded by buckle chute folders while retaining the ability to fold a single sheet.

SUMMARY OF THE INVENTION

Accordingly, the instant invention provides a buckle chute folder for folding one or more sheets of paper. The folder includes a buckle chute and a pair of folding rollers situated downstream of the buckle chute. Each of the folding rollers has a plurality of circumferential grooves extending perpendicular to the axis of the roller, and the grooves of one roller are offset with respect to the grooves of the other roller.

DETAILED DESCRIPTION OF THE PREFERRED EMBODIMENT

Figure 1:
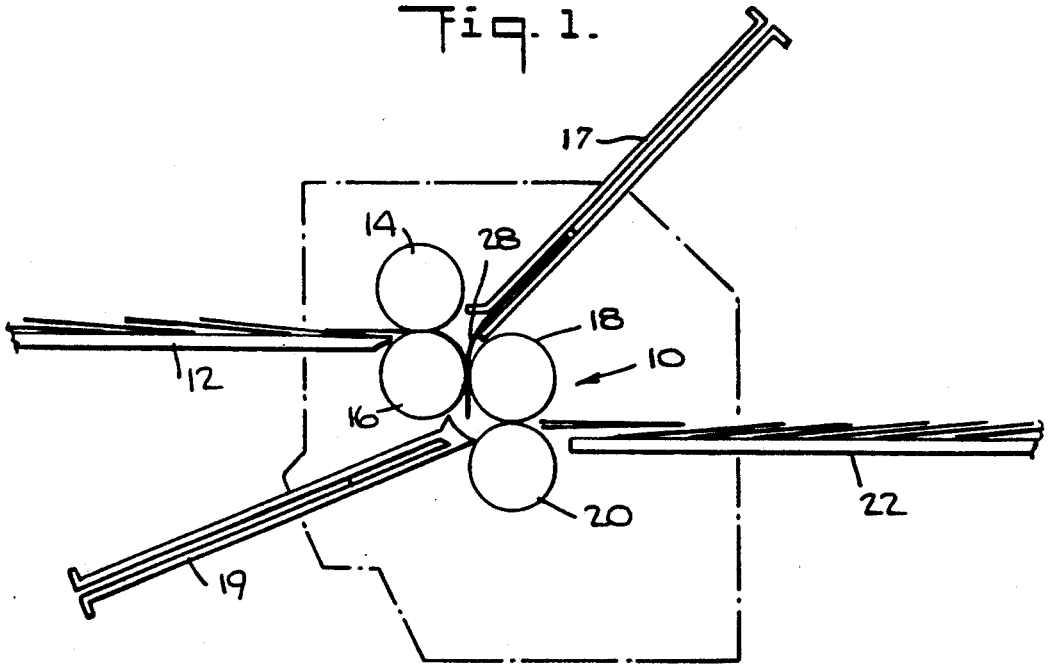
FIG. 1 is a side, elevational view of a buckle chute folder employing folding rollers in accordance with the instant invention.

In describing the preferred embodiment of the instant invention, reference is made to the drawings wherein there is seen in FIG. 1 buckle chute folding apparatus generally designated 10 capable of imparting two successive folds to a single sheet of paper or a collation of several sheets of paper. The folding apparatus 10 includes a paper guide deck 12 for feeding sheets of paper from paper handling devices (not shown) located upstream, such as feeders and collators, to the feed rollers 14 and 16. Downstream of the rollers 14 and 16 is a first buckle chute 17 which functions in conventional manner and thus requires no further explanation. Downstream of the buckle chute 17 is the first pair of folding rollers consisting of the aforementioned feed roller 16 which doubles as a folding roller, and a folding roller 18. Downstream of the rollers 16 and 18 is a second buckle chute 19 downstream of which is located a second pair of folding rollers consisting of the aforementioned folding roller 18 and a folding roller 20. Downstream of the folding rollers 18 and 20 is an exit deck 22 for guiding the folded paper sheets downstream for further processing.

Figure 2:
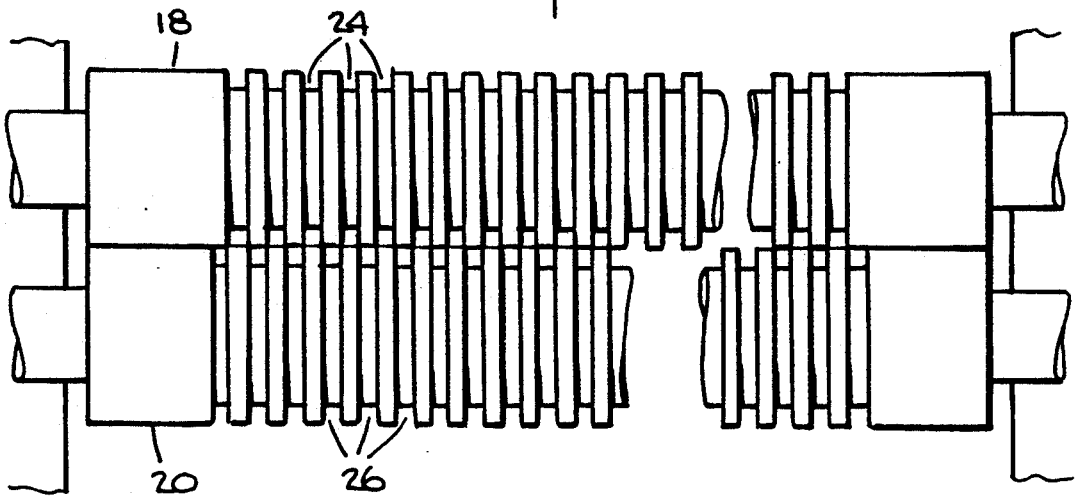
FIG. 2 is a front, elevational view of pair of folding rollers in accordance with the instant invention.
Figure 3:
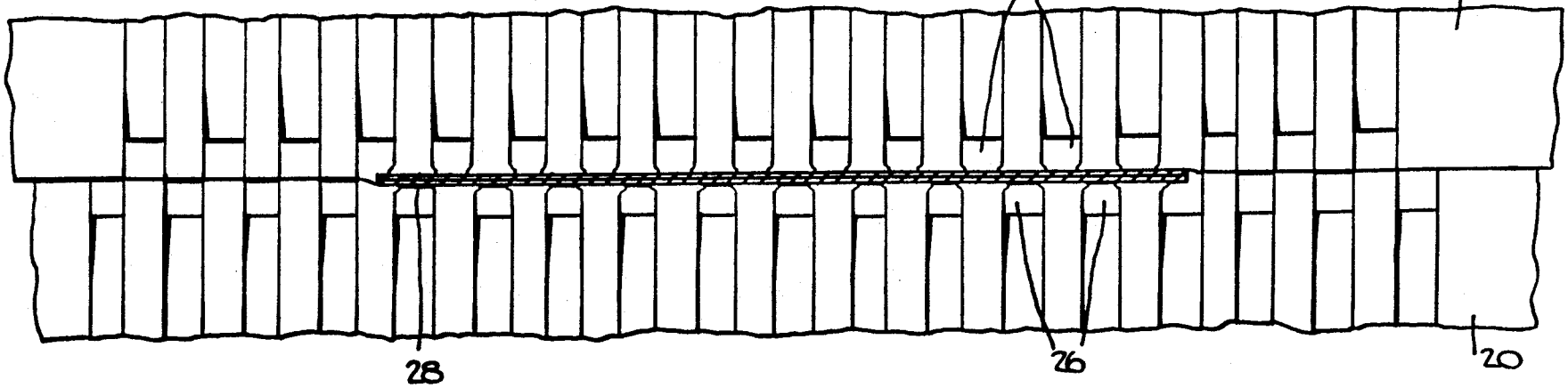
FIG. 3 is an enlarged, front, elevational view of the folding rollers seen in FIG. 2 folding a single sheet of paper in half.
Figure 4:
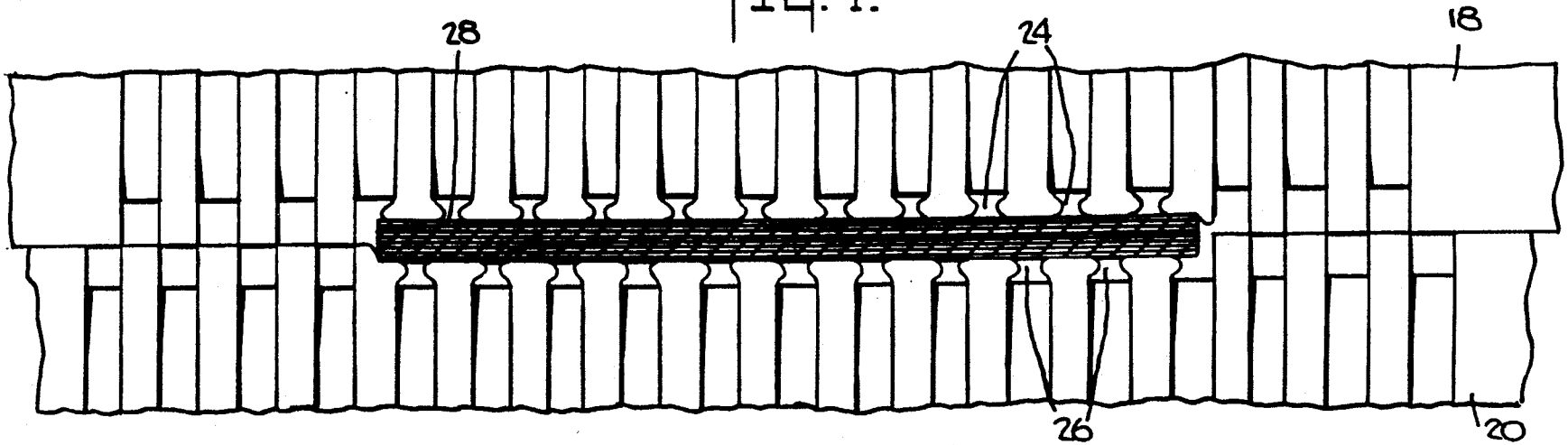
FIG. 4 is similar to FIG. 3 but shows a packet of four sheets of paper being folded in half.
Figure 5:
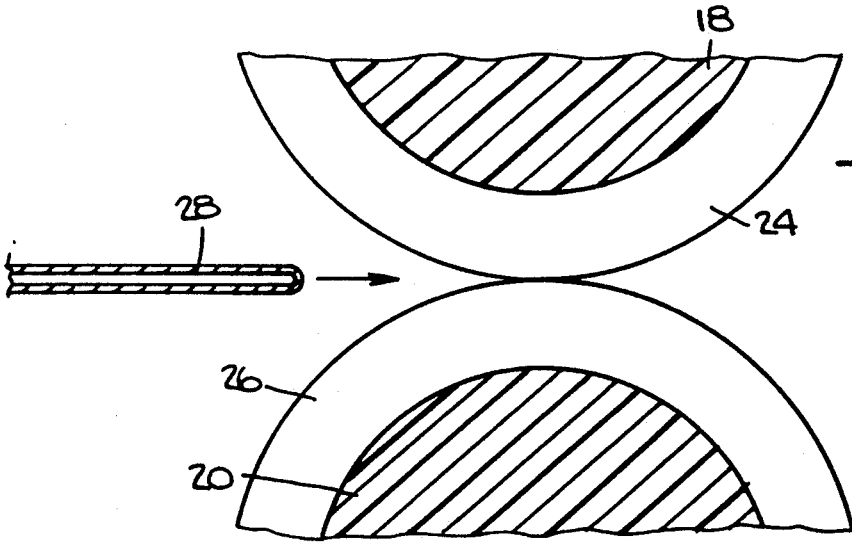
FIG. 5 is an enlarged, side elevational view of the folding rollers seen in FIG. 2 prior to a single, buckled sheet of paper entering the nip of the folding rollers.

The feed roller 14 preferably is constructed of conventional rubber or plastic material in solid, cylindrical form. The folding rollers 16, 18 and 20 are formed from the same material as the feed roller 14, but each of the rollers 16, 18 and 20 contains a series of grooves, and as best seen in FIG. 2, the rollers 18 and 20 contain a series of grooves 24 and 26 respectively. The grooves 24 of the roller 18 are offset with respect to the grooves 26 of the roller 20. In the preferred embodiment, the grooves 24 and 26 are machined or molded into the rollers 18 and 20 respectively to a depth of $\frac{1}{8}''$ at intervals of $\frac{1}{8}''$ or greater while maintaining equal distances between the adjacent grooves 24 and 26.

Figure 6:
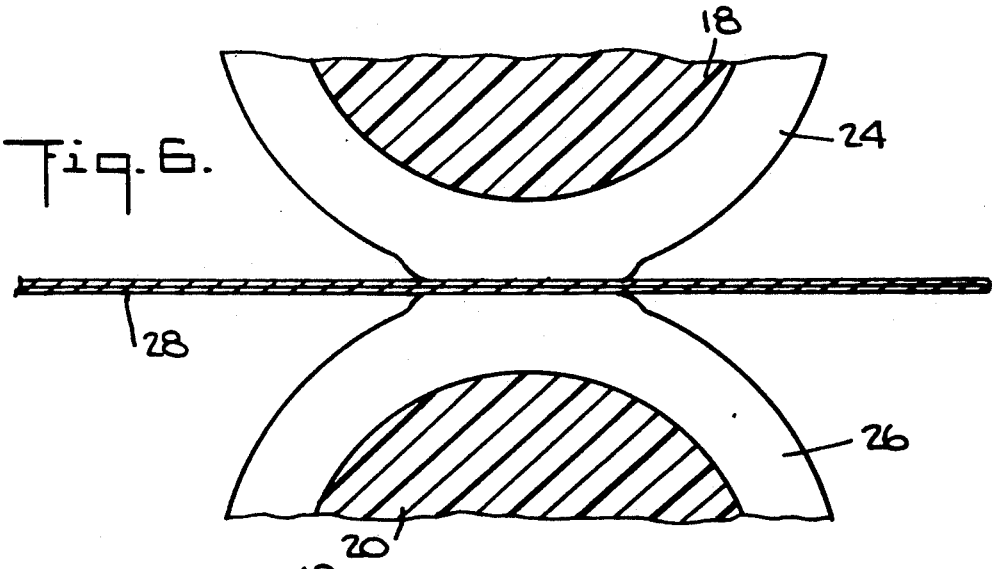
FIG. 6 is similar to FIG. 5 but shows the single sheet of paper after it has been folded and between the folding rollers.
Figure 7:
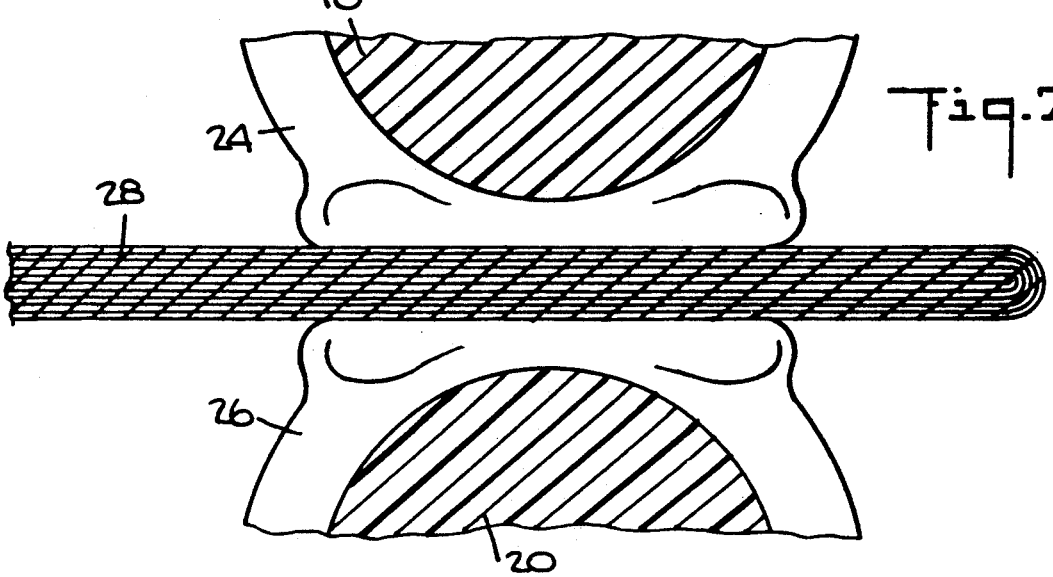
FIG. 7 is similar to FIG. 6 but shows 5 sheets of paper having been folded.

In operation, referring now to FIG. 1, a sheet of paper 28 is fed through the pair of rollers 14 and 16 up into the buckle chute 17, where the leading edge of the paper 28 is stopped, thereby causing a buckle to be formed in the paper 28, which is then forced to enter the nip of the folding rollers 16 and 18. Although FIG. 1 shows a single sheet of paper 28 being folded, the folding apparatus seen in FIG. 1 can be used to fold a group of paper sheets 28 as seen in FIG. 7. When the paper sheets 28, whether a single sheet or a group of sheets, are being fed between a pair of grooved folding rollers, such as rollers 16 and 18, the ungrooved folding roller surface portions will give or collapse (see FIGS. 6 and 7) into the void area created by the grooves, thus allowing a large group of paper sheets 28 to pass between a pair of folding rollers while maintaining a constant pressure.

From the foregoing, it can be seen that the folding rollers described hereinabove are capable of folding a single sheet at a time with the requisite quality of fold, as well as a packet of sheets containing as many as 14 sheets or more. Experience has demonstrated that the quality of the fold is superior with the folding rollers of the instant invention, and that the range of numbers of sheets which can be folded simultaneously is increased using the folding rollers of the instant invention. The folding rollers described herein allow a quality fold for both thin and thick collations, whereas conventional folding rollers can provide a quality fold for only a thick or thin collation; i.e., if the adjustment is set for quality folding with a small number of sheets, the quality of the folding for a large number of sheets is lost.

It should be understood by those skilled in the art that various modifications may be made in the present invention without departing from the spirit and scope thereof, as described in the specification and defined in the appended claims.

What is claimed is:

1. A buckle chute folder for folding one or more sheets of paper, comprising:

a buckle chute; and a pair of folding rollers situated downstream of said buckle chute, each of said folding rollers having a plurality of circumferential grooves extending perpendicular to the axis of said roller, and wherein the grooves of one roller are offset with respect to the grooves of the other roller.

2. The folder according to claim 1, wherein the distances between said grooves are equal.

3. The folder according to claim 2, wherein the grooves have a depth of about $\frac{1}{8}$ inch.

4. The folder according to claim 3, wherein the grooves have intervals of at least $\frac{1}{8}$ inch.

5. The folder according to claim 4, wherein the folding rollers are formed from rubber or plastic material in solid, cylindrical form.

6. A buckle chute folder for folding one or more sheets of paper, comprising:

a buckle chute;

a pair of folding rollers situated downstream of said buckle chute, each of said folding rollers having a resilient outer surface with a plurality of individual circumferential grooves, wherein each of said grooves are situated perpendicular to the axis of said roller, and the distance between adjacent ones of said grooves are equal, and wherein the grooves of one roller are offset with respect to the grooves of the other roller.

* * * * *